US010961612B2

(12) United States Patent
Hofbauer et al.

(10) Patent No.: US 10,961,612 B2
(45) Date of Patent: Mar. 30, 2021

(54) METHOD FOR CONTROLLING THE COILING TEMPERATURE OF A METAL STRIP

(71) Applicant: Andritz AG, Graz (AT)

(72) Inventors: Thomas Hofbauer, Mödling (AT); Florian Leeber, Vienna (AT); Walter Kautz, Neulengbach (AT); Martin Fein, Vienna (AT)

(73) Assignee: Andritz AG, Graz (AT)

( * ) Notice: Subject to any disclaimer, the term of this patent is extended or adjusted under 35 U.S.C. 154(b) by 248 days.

(21) Appl. No.: 15/989,329

(22) Filed: May 25, 2018

(65) Prior Publication Data

US 2018/0340246 A1 Nov. 29, 2018

(30) Foreign Application Priority Data

May 29, 2017 (AT) ..... A 50450/2017

(51) Int. Cl.

| | |
|---|---|
| ***C22F 1/04*** | (2006.01) |
| ***B21C 47/02*** | (2006.01) |
| ***C21D 9/56*** | (2006.01) |
| ***C21D 11/00*** | (2006.01) |
| ***C21D 9/46*** | (2006.01) |

(52) U.S. Cl.

CPC ..... *C22F 1/04* (2013.01); *B21C 47/02* (2013.01); *C21D 9/56* (2013.01); *C21D 11/00* (2013.01); *C21D 9/46* (2013.01)

(58) Field of Classification Search

CPC .. C22F 1/04; B21C 47/02; C21D 9/56; C21D 11/00; C21D 9/46

See application file for complete search history.

(56) References Cited

U.S. PATENT DOCUMENTS 3,517,916 A * 6/1970 Ross ..... C21D 11/00 266/87
2010/0219567 A1* 9/2010 Imanari ..... C21D 11/005 266/44

FOREIGN PATENT DOCUMENTS

JP 2001026851 A * 1/2001

OTHER PUBLICATIONS

Seborg et al. ("Process dynamics and control. 2010." Edition 3rd p. 386-399) (Year: 2010).*
JP2001026851 original (Year: 2001).*

* cited by examiner

*Primary Examiner* — Anthony J Zimmer
*Assistant Examiner* — Ricardo D Morales
(74) *Attorney, Agent, or Firm* — Alix, Yale & Ristas, LLP

(57) ABSTRACT

A method for coiling a metal strip that is heat-treated in a furnace immediately before coiling and fed to a coiler at an outlet speed, and then coiled at the coiler at an elevated temperature. The future outlet speed of the metal strip and the heat losses from the metal strip between the furnace and the coiler are calculated via a predictive model and the furnace is controlled by the predictive model such that the metal strip is coiled at a pre-defined temperature within a maximum deviation of +/−5° C.

19 Claims, 1 Drawing Sheet

METHOD FOR CONTROLLING THE COILING TEMPERATURE OF A METAL STRIP

BACKGROUND

The inventive embodiments of the disclosure concern a method for coiling a metal strip, and in particular a method where the metal strip is heat-treated in a furnace immediately before the coiling process, fed to a coiler at an outlet speed, and then coiled there in a warm state at a predefined temperature.

In the production of metal strip it has proved very useful to coil certain metals and metal alloys in a warm state. The strip processing step, also referred to as pre-aging, takes place at the end of modern annealing lines for aluminum strip, for example. Here, the strip is heated during a reheating process in a pre-aging furnace. This makes coiling possible in this way at a suitable temperature. As a result of coiling at a suitable temperature and due to the slow cooling-down process of the coil, the material properties of the metal strip can be improved. It is very important here for the strip to be coiled at exactly the temperature defined, if possible.

The metal strips are normally fed to the annealing line as coils, then uncoiled, and re-coiled again at the end of the line. In order to make continuous operation possible in the annealing line, the tail of a leading strip is joined to the head of the following strip, referred to herein as a "strip connection", which can be by welding or stitching, for example. The metal strip can be coiled at the end of the line at a higher speed. Here, outlet speeds in the region of 200 m/min are possible; however this speed must be reduced considerably for a coil change and for cutting through the metal strip. In some cases, the metal strips also have to be halted briefly, for setting the trimming shears for example. In order to ensure that the metal strip can still pass through the annealing furnace continuously at a constant speed, a looper is provided before and after the annealing furnace to absorb the different inlet and outlet speeds of the metal strip.

As already mentioned above, there is also another furnace in the outlet section in many cases, also known as the pre-aging furnace. This furnace is also referred to in professional circles as a bake-hardening furnace, pre-bake furnace, reheating furnace, or paint-bake furnace. The metal strip is heated there, to a temperature between 50° C. and 150° C., for example, so that it can be coiled at a defined temperature. As a result of the changing outlet speed, the dwell times of the metal strip in the pre-aging furnace also change and with them the temperature of the metal strip. In existing plants, therefore, the strip temperature is measured shortly before the coiler, and the pre-aging furnace is controlled according to the temperature measured there so that the strip temperature at the coiler remains as constant as possible.

With this control system, however, the strip temperature can only be kept constant by +/−10° C. because of relatively sluggish reaction times in the furnace. However, the strip temperature accuracy that can be achieved in this way is too inexact or variable for some applications wherein a deviation of even 1-2° C. can impact the material properties.

It would thus be useful to provide a method or system that controls the strip temperature more accurately during coiling.

SUMMARY

In the disclosed method, greater control of temperature is achieved with a coiling process in which the future outlet speed of the metal strip and the heat losses from the metal strip between the furnace and the coiler are calculated using a predictive model, wherein parameters of the furnace are then automatically controlled in such a way that the metal strip can be coiled at the specified temperature with a maximum deviation of +/−5° C.

With this predictive model, the future outlet speed of the metal strip and the heat losses upstream of the coiler depending on the outlet speed are used to control the furnace before there is any change in the outlet speed. As a result of this intervention in the system at an early stage, the outlet temperature can be maintained very accurately, ideally by even less than a deviation of +/−2° C. from the desired coiling temperature.

In most cases, the metal strip is heated in the furnace using hot air that is blown onto the metal strip by fans. Due to the change in the air temperature resulting from a change in the burner output or fan speed for example, the desired amount of heat can be transferred to the strip and the strip temperature controlled in this way.

It is also feasible for the furnace to transfer the heat to the metal strip by radiation (e.g. infra-red radiator) or electromagnet effects (e.g. eddy currents, induction). These furnaces can be controlled quite easily by means of the electric power supply.

The disclosed method is particularly suitable for aluminum strip.

Preferably, the outlet speed of the metal strip from the furnace is also controlled by the predictive model so that an optimum filling level is always maintained in the looper.

BRIEF DESCRIPTION OF THE DRAWINGS

The disclosed embodiments will be described with reference to the drawings, wherein.

DETAILED DESCRIPTION

Figure 1:
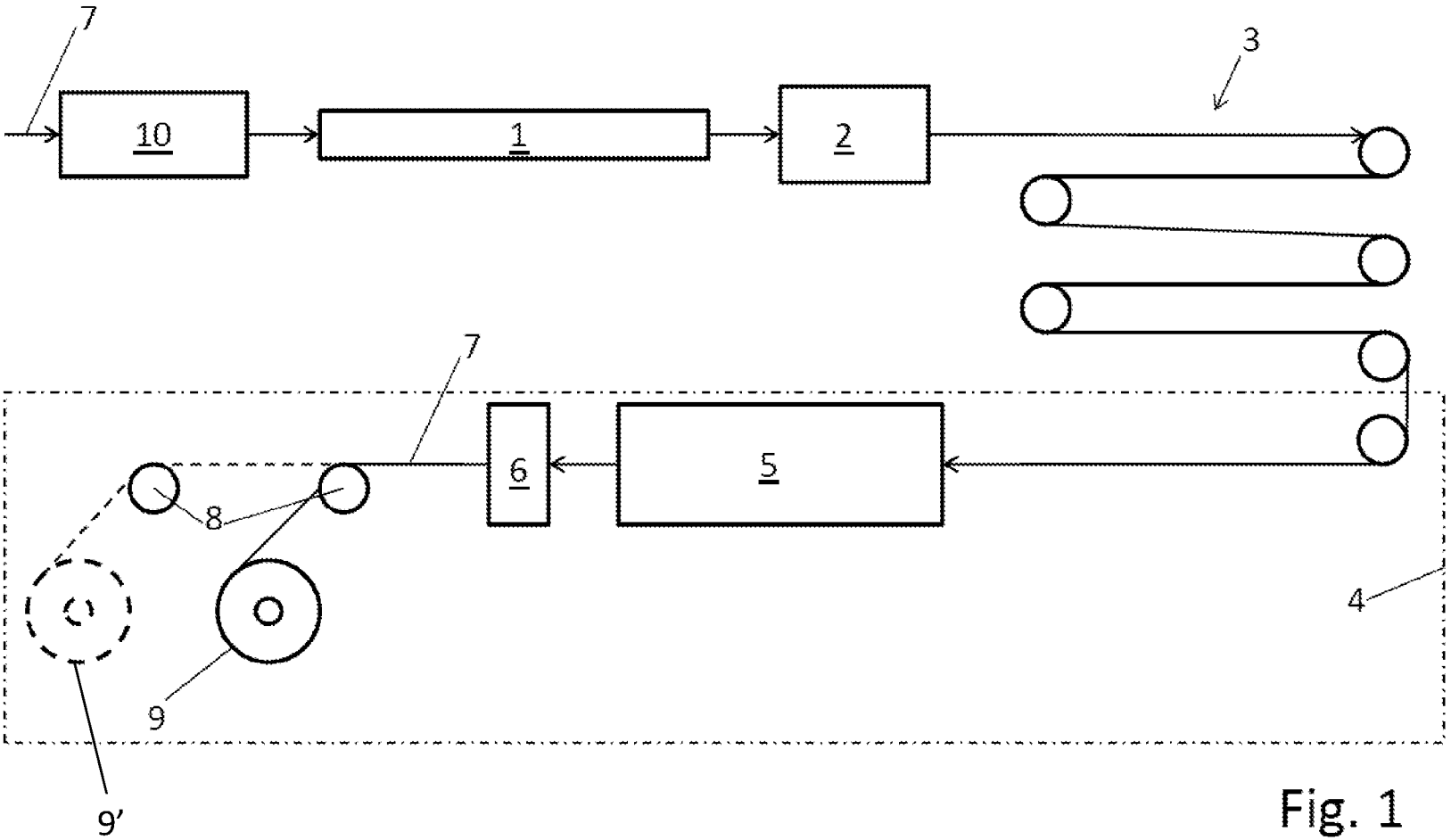
FIG. 1 is a schematic representation of an exemplary system for performing the disclosed method.

In the following, the inventive embodiments are described based on the representative example shown in FIG. 1.

FIG. 1 shows part of an annealing line. Here, the metal strip 7 passes through an annealing furnace 10, a chemical treatment section (pickling section) 1, and a peak metal temperature (PMT) dryer 2 at a substantially constant speed (process speed). The process speed is preferably within the region of approximately 120 m/min. The metal strip 7 is fed at a constant speed to the looper 3 and leaves it at an outlet speed that varies during operation.

As noted, there are two or more strips in the line at a given time with a respective trailing end and a respective leading end connected via welding or a stitch. In a normal sequence to change out a coil 9 or 9' and to cut and remove a leading strip, the strip speed is reduced from the process speed (120 m/min, for example) to a cutting speed (30 m/min, for example), a scrap cutting speed (50 m/min, for example), and then to a threading speed (30 m/min, for example). During this period, a trailing strip in the strip 7 continues to be fed to the exit looper 3 at normal production speed in the central process section, shown upstream of the outlet section 4 in FIG. 1. During this period, the exit from the looper slows down and the exit looper 3 fills with the trailing strip. After the leading strip is been cut, the trailing strip is recoiled on the replacement coil 9' to continue the process. As soon as the core of the new coil 9' comprising the trailing strip is wound, the build-up of the trailing strip in the exit looper 3 is emptied at overrunning speed (160-200 m/min, for example) before the outlet speed is reduced again to process speed (120 m/min, for example).

In the outlet section 4, the metal strip 7 is heated in a furnace 5, guided over a deflector roll 8, and fed to the coiler 9. At the coiler 9, the metal strip 7 is coiled in a warm state at a pre-defined temperature. This pre-defined temperature is typically within a range of approximately 40° C.-150° C., and preferably within a range of approximately 50° C.-130° C. If the coil 9 needs to be changed, the strip speed is reduced and the metal strip is cut through by the outlet shears 6. The head of a new strip is then coiled in a warm state by a second/replacement coiler 9' located behind the first coiler 9.

In order to maintain the defined temperature at the coiler as accurately as possible, the future outlet speed of the metal strip and the heat losses from the metal strip caused by traveling from the furnace 5 to the coiler 9 or 9' are calculated using a predictive model, which automatically controls parameters of the system, including parameters of the furnace 5. With the calculated temperature $T_C$ provided by the predictive model, the temperature of the furnace 5 is automatically maintained at a temperature $T_F$ to ensure that the metal strip is coiled at the corrected defined temperature with a maximum deviation of +/−5° C. Forward-looking consideration of the coil connection (e.g. stitched or welded seam) permits forward-looking modeling of the outlet speed, the outlet looper filling level, the strip temperature at the furnace 5 outlet, and the coiling temperature $T_C$ in consideration of the heat losses between furnace outlet and coiler 9 or 9'.

In the predictive model described above, numerous parameters are taken into consideration in controlling the strip temperature, including:

- the defined coiling temperature $T_C$;
- the production speed;
- the outlet speed of the metal strip;
- the strip thickness;
- the strip width;
- the filling level of the outlet strip looper;
- the strip temperature at the inlet to the furnace (pre-aging furnace);
- the strip temperature at the furnace outlet;
- the strip temperature at the outlet from the PMT (peak metal temperature) dryer/furnace;
- the ambient air temperature in the outlet area;
- the strip lengths between the PMT dryer, the furnace, and the coiler;
- the lengths of reject that have to be cut out before and after the strip connection;
- the number of samples that have to be cut out before and after the strip connection;
- the position of the strip connection;
- the temperature at the deflector roll upstream of the coiler; and/or
- if there are several coilers, which coiler is in use.

Of course, it is not necessary to take all of these model parameters into account.

For example, typically the model calculates an expected coiling temperature $T_C$ based on other disclosed parameters in rapid intervals, and automatically makes alterations to parameters according defined rules if the calculated/predicted coiling temperature deviates from the set point for the desired coiling temperature $T_C$ and also makes alterations to parameters in advance if a change in exit section speed is expected due to a coil change sequence.

In addition to controlling the coiling temperature $T_C$ of the metal strip, the following parameters are automatically revised or controlled by the predictive model to affect a predetermined preferred result:

- the outlet speed of the metal strip from the furnace;
- the temperature set point in the furnace $T_F$ (often, it can take up to 1 minute or longer once temperature set point is changed for actual furnace air temperature to change commensurately);
- the heat transfer in the furnace (impacted directly by fan speed, in a preferred embodiment);
- the filling level of the outlet strip looper;
- the strip temperature at the inlet to the furnace if there is a PMT dryer available;
- the strip temperature at the furnace outlet;
- the strip temperature at the outlet from the PMT dryer if available; and/or
- the furnace cooling by controlling the supply of ambient air to the furnace.

EXAMPLE 1

An illustrative representative example is described below, with $T_F$ being the air temperature inside the furnace (which in addition to other parameters like fan speed, exit speed and strip dimensions, impacts the strip temperature leaving the furnace), wherein

- exit speed is approximately 120 m/min;
- furnace temperature $T_F$ is approximately 250° C.;
- strip temperature at the outlet of the furnace is 100° C.; and
- desired coiling temperature $T_C$: 90° C.

During the coil change, the speed is changed from 120 m/min to 0 m/min to 160 m/min, then back to 120 m/min. In theory, this would require the furnace temperature $T_F$ to fluctuate from 250° C. to 100° C. to 300° C. and back to 250° C. within seconds to maintain the desired coiling temperature $T_C$ at every immediate interval of speed changes.

The model achieves the desired coiling temperature within the specified maximum deviation, by predicting the $T_C$ with the currently-set desired parameters and varying the parameters in advance to upcoming necessary speed changes.

The coiling temperature depends on the cooling of the strip between exit of the furnace and the coiler, which can be between 10 and 30 m, as there are 2 different coiler positions. The cooling of the representative strip between the furnace outlet and coil 9 or 9' depends on variable such as strip thickness, exit velocity, ambient air temperature and length between furnace outlet and coil (i.e., the relative position of the coil).

What is claimed is:

1. In an annealing line wherein a metal strip (7) travels at a strip speed that fluctuates from a substantially constant process speed, a method for coiling a leading metal strip (7) that extends from a head to a tail with the tail connected at a strip connection to a head of a trailing metal strip, comprising the steps of:

(a) guiding the leading metal strip (7) through a furnace (5) to heat treat the leading metal strip (7), (b) feeding the leading strip (7) to a coiler (9, 9') immediately after the furnace (5) at an outlet speed, (c) coiling the leading strip (7) with the coiler (9, 9') at an actual coiling temperature, (d) determining a desired coiling temperature $T_C$ of the leading metal strip (7);

(e) calculating an expected coiling temperature at multiple points in time as the leading strip is traveling at the strip speed using as data points:
  (i) a future outlet speed of the leading metal strip (7) leaving the furnace (5),
  (ii) heat loss of the leading metal strip (7) between the furnace (5) and the coiler (9, 9'),
  (iii) strip speed of the leading strip (7), and
  (iv) a position of the strip connection in the annealing line, (f) automatically raising a temperature $T_F$ of the furnace when the expected coiling temperature calculated in step (e) is lower than the desired coiling temperature $T_C$, and automatically lowering the temperature $T_F$ of the furnace when the predictive model calculates an expected coiling temperature that is higher than the desired coiling temperature calculated in step (e) such that the leading metal strip (7) is coiled at the actual coiling temperature that is within a deviation of +/−5° C. of the desired coiling temperature $T_C$.

2. In an annealing line wherein a metal strip (7) travels at a strip speed that fluctuates from a substantially constant process speed, a method for coiling a leading metal strip (7) with a thickness and a width and which extends from a head to a tail with the tail connected at a strip connection to a head of a trailing metal strip, comprising the steps of:

(a) guiding the leading metal strip (7) through a furnace (5) to heat treat the leading metal strip (7) via hot air blown with a fan, (b) feeding the leading strip (7) to a coiler (9, 9') immediately after the furnace (5) at an outlet speed, (c) coiling the leading strip (7) with the coiler (9, 9') at an actual coiling temperature, (d) determining a desired coiling temperature $T_C$ of the leading metal strip (7);

(e) calculating an expected coiling temperature at multiple points in time as the leading strip is traveling at the strip speed using as data points:
  (i) a future outlet speed of the leading metal strip (7) leaving the furnace (5),
  (ii) heat loss of the leading metal strip (7) between the furnace (5) and the coiler (9, 9'),
  (iii) strip speed of the leading strip (7),
  (iv) the thickness and the width of the leading metal strip (7), and
  (iv) a position of the strip connection in the annealing line, (f) automatically raising a temperature $T_F$ of the furnace when the expected coiling temperature calculated in step (e) is lower than the desired coiling temperature $T_C$, and automatically lowering the temperature $T_F$ of the furnace when the predictive model calculates an expected coiling temperature that is higher than the desired coiling temperature calculated in step (e) such that the leading metal strip (7) is coiled at the actual coiling temperature that is within a deviation of +/−5° C. of the desired coiling temperature $T_C$.

3. The method of claim 1, wherein the step of calculating (e) is repeated numerous times throughout the coiling of the leading metal strip (7).

4. The method of claim 2, wherein the step of calculating (e) is repeated numerous times throughout the coiling of the leading metal strip (7).

5. The method of claim 1, wherein the leading metal strip (7) is coiled at an actual coiling temperature with a maximum deviation of +/−2° C. from the desired coiling temperature $T_C$.

6. The method of claim 1, wherein the leading metal strip (7) is heated in the furnace (5) using hot air that is blown onto the leading metal strip (7) by fans and the furnace temperature is controlled by changing the air temperature or the fan speed.

7. The method of claim 1, wherein the leading metal strip (7) is made from aluminium.

8. The method of claim 1, wherein the desired coiling temperature $T_C$ is set within a range of approximately 40° C.-150° C.

9. The method of claim 1, wherein the leading metal strip (7) has a thickness and a width, and the step of calculating (e) additionally uses the strip thickness and width in determining how to automatically change parameters of the annealing line.

10. The method of claim 1, wherein an actual coiling temperature $T_C$ of the leading metal strip (7) is measured and additionally used in the step (e) of calculating to assist in determining whether to automatically raise or lower the temperature $T_F$ of the furnace (5).

11. The method of claim 1, wherein a temperature of the ambient air between the furnace (5) and coiler (9, 9') is measured and additionally used in the step (e) of calculating to assist in determining whether to automatically raise or lower the temperature $T_F$ of the furnace (5).

12. The method of claim 1, wherein one or more of the actual strip temperature before entering the furnace (5) and the actual strip temperature after leaving the furnace (5) is measured and additionally used in the step (e) of calculating to assist in determining whether to raise or lower the temperature $T_F$ of the furnace (5).

13. The method of claim 1, wherein an outlet speed of the leading metal strip (7) from the furnace is also automatically increased or decreased in response to the step (e) of calculating an expected coiling temperature.

14. The method of claim 2, wherein an actual coiling temperature $T_C$ of the leading metal strip (7) is measured and additionally used in the step (e) of calculating to assist in determining whether to automatically raise or lower the temperature $T_F$ of the furnace (5).

15. The method of claim 2, wherein a temperature of the ambient air between the furnace (5) and coiler (9) is measured and additionally used in the step (e) of calculating to assist in determining whether to automatically raise or lower the temperature $T_F$ of the furnace (5).

16. The method of claim 2, wherein one or more of an actual strip temperature of the leading metal strip before entering the furnace (5) and the actual strip temperature of the leading metal strip after leaving the furnace (5) is measured and additionally used in the step (e) of calculating to assist in determining whether to raise or lower the temperature $T_F$ of the furnace (5).

17. The method of claim 2, wherein the desired coiling temperature $T_C$ is set within a range of approximately 40° C.-150° C.

18. The method of claim 2, wherein the leading metal strip (7) is coiled at an actual coiling temperature with a maximum deviation of +/−2° C. from the desired coiling temperature $T_C$.

19. The method of claim 2, wherein the leading metal strip (7) is made from aluminum.

* * * * *